US006048678A

United States Patent [19]

Schwark et al.

[11] Patent Number: 6,048,678

[45] Date of Patent: Apr. 11, 2000

[54] PROTECTIVE OVERCOAT COATING COMPOSITIONS

[75] Inventors: Dwight W. Schwark, Rochester; Yongcai Wang, Penfield; Robert J. Kress, Rochester, all of N.Y.

[73] Assignee: Eastman Kodak Company, Rochester, N.Y.

[21] Appl. No.: 09/221,516

[22] Filed: Dec. 28, 1998

[51] Int. Cl.[7] ..... G03C 1/85; G03G 1/76

[52] U.S. Cl. ..... 430/527; 430/523; 430/531; 430/533; 430/536; 430/950; 430/961

[58] Field of Search ..... 430/523, 527–530, 430/531, 533, 536, 950, 961

[56] References Cited

U.S. PATENT DOCUMENTS

| | | | |
|---|---|---|---|
| 4,582,784 | 4/1986 | Fukugawa et al. | 430/531 |
| 4,612,279 | 9/1986 | Steklenski et al. | 430/523 |
| 4,735,976 | 4/1988 | Steklenski et al. | 524/32 |
| 5,173,739 | 12/1992 | Kurachi et al. | 356/124 |
| 5,695,919 | 12/1997 | Wang et al. | 430/531 |

FOREIGN PATENT DOCUMENTS 476535 8/1997 European Pat. Off. .

*Primary Examiner*—Richard L. Schilling
*Attorney, Agent, or Firm*—Doreen M. Wells

[57] ABSTRACT

The present invention is an imaging element which contains a support, an image forming layer superposed on the support and an outermost protective layer superposed on the support. The protective layer is a cellulosic material and a composite wax particle. The wax particle is composed of a wax phase and a non-crosslinked polymer phase. The wax phase includes a wax having a melting point of greater than 30° C. The non-crosslinked polymer phase contains from 10% to 80% by weight of a mono-alpha, beta-ethylenically unsaturated monomer capable of addition polymerization to form a water soluble homopolymer. In a preferred embodiment the protective layer overlies an antistatic layer.

16 Claims, No Drawings

PROTECTIVE OVERCOAT COATING COMPOSITIONS

CROSS REFERENCE TO RELATED APPLICATIONS

This application relates to commonly assigned copending application Ser. No. 09/221,639, filed simultaneously herewith. This application relates to commonly assigned copending application Ser. No. 09/221,469, filed simultaneously herewith. This application relates to commonly assigned copending application Ser. No. 09/221,083, filed simultaneously herewith. This application relates to commonly assigned copending application Ser. No. 09/221,470, filed simultaneously herewith. This application relates to commonly assigned copending application Ser. No. 09/221,465, filed simultaneously herewith. This application relates to commonly assigned copending application Ser. No. 09/221,776, filed simultaneously herewith. This application relates to commonly assigned copending application Ser. No. 09/221,883, filed simultaneously herewith. These copending applications are incorporated by reference herein.

FIELD OF THE INVENTION

This invention relates to imaging elements, and in particular to photographic elements having a protective overcoat layer with improved physical properties and manufacturability. In particular, the protective overcoat provides the elements with excellent barrier properties, excellent resistance to surface haze or scum formation and blistering during photographic processing, excellent frictional properties, and excellent protection against mechanical scratch and high humidity ferrotyping.

BACKGROUND OF THE INVENTION

Photographic light-sensitive materials are generally composed of light-sensitive photographic emulsion layers and light insensitive layers such as an interlayer, an emulsion protective layer, a filter layer, or an antihalation layer applied, directly or indirectly through a subbing layer, to one side or both sides of the support consisting of, for example, an α-olefin such as polystyrene or polyethylene, a cellulose ester such as cellulose acetate or nitrocellulose, a polyester such as polyethylene terephthalate or polyethylene naphthalate, paper, or a synthetic paper. In light-sensitive materials such as color photographic elements, auxiliary layers such as an antistatic layer, a curl preventing layer, a magnetic recording layer, a barrier layer, a scratch resistant overcoat layer, or a surface lubricant layer, are provided on the back side of the support in order to enhance the photographic or physical quality of the photographic light-sensitive materials.

It is always desirable to have a backside protective overcoat that serves as many of these functions as possible in order to reduce manufacturing complexity and cost. It is also desirable to have such a layer formed by coating and drying from coating compositions based on solvents that are less hazardous to the environment.

The need to provide photographic film and paper with antistatic protection has long been recognized. Such protection is important since the accumulation of static charges as a result of various factors in the manufacture, finishing, and use of photographic elements is a serious problem in the photographic art. To overcome the problem of accumulation of static charges it is conventional practice to provide an antistatic layer (i.e., an electrically-conductive layer) in photographic elements. A wide variety of antistatic layers are known for use in photographic elements.

Prior art has disclosed the use of a protective overcoat or a "barrier" layer to maintain post-process conductivity of an underlying antistatic layer. Typically such protective overcoats consist of hydrophobic materials such as cellulose acetates, cellulose acetate butyrates, cellulose acetate propionates, cellulose nitrates, polyacrylates, polymethacrylates, polystyrene, and poly(vinyl acetal).

When such hydrophobic barrier layers are used as an outermost surface layer, deposition of material or "scum" formation on the outermost surface following photographic processing is commonly seen. For example, U.S. Pat. No. 4,735,976 discusses how surfactant from the final photographic processing solution, known as the stabilizer solution, can form a deposit on the outermost surface layer and thereby lead to an objectionable surface haze or scum. Similarly, U.S. Pat. No. 4,582,784 discusses the occurrence of spotted drying unevenness on the outermost surface. Another type of processing scum that is particularly troublesome is hard-water scum. Processing laboratories that are located in hard-water areas are particularly susceptible to this problem. After processing in solutions prepared using hard-water, a white hazy surface scum, sometimes uniform and sometimes more liney and streaky, can be seen on the film. Chemical analysis of the hard-water scum typically reveals hard-water salts of calcium, magnesium, and sodium.

Such surface deposits can impact the physical performance of the element in a variety of ways. For example, large deposits of material on a photographic film lead to readily visible defects on photographic prints or are visible upon display of motion picture film. Alternatively, post-processing debris can influence the ability of a processed film to be overcoated with an ultraviolet curable abrasion resistant layer, as is done in professional photographic processing laboratories employing materials such as PhotoGard®, 3M. Finally, processing residue on photographic elements can impact the ability to read or write magnetically recorded information on a processed film, such as the new Advanced Photographic System film.

U.S. Pat. Nos. 4,612,279 and 4,735,976, incorporated by reference herein, describe a protective overcoat comprising a blend of cellulose nitrate and a copolymer containing acrylic or methacrylic acid for eliminating objectionable surface haze or scum formed during photographic processing. U.S. Pat. No. 4,582,784 describes an uppermost surface layer composed of a hydrophobic cellulose ester polymer and a hydrophilic vinyl polymer for reducing the spotted drying unevenness. However, layer compositions disclosed in the above art do not provide adequate barrier properties and adequate resistance to mechanical scratch and high humidity ferrotyping.

High humidity ferrotyping becomes a problem especially for photographic systems such as the so-called Advanced Photographic Systems where the processed element may be re-introduced into a cassette. Such a system allows for compact and clean storage of the processed element until such time when it may be removed for additional prints or to interface with display equipment. Storage in the roll is preferred to facilitate location of the desired exposed frame and to minimize contact with the negative. U.S. Pat. No. 5,173,739 discloses a cassette designed to thrust the photographic element from the cassette, eliminating the need to contact the film with mechanical or manual means. Published European Patent Application 0 476 535 A1 describes how the developed film may be stored in such a cassette. The dimensions of such a so-called thrust cassette requires that the processed photographic element is wound tightly and under pressure, causing direct close contact between the front and back sides which results in ferrotyping, especially at high temperature and high relative humidity.

A surface lubricant layer is normally applied as the outermost layer, as is the case for a backing layer. It is desirable for this layer to have a low coefficient of friction (COF) to provide proper conveyance properties and to protect the imaging element from mechanical damage (i.e. scratching, marring, etc.) during the manufacturing process and customer use. Imaging elements may be protected against mechanical damage by coating them with a layer comprising a lubricant such as a wax. However, it has proven difficult to incorporate the lubricant into the underlying layer, since it is difficult to find a organic medium that dissolves both the components of the underlying layer and the lubricant, and is at the same time attractive from an environmental and health standpoint. Similarly, it is difficult to form a stable dispersion of a lubricant, such as a wax, in an organic medium that may be added to the coating composition for the underlying layer. U.S. Pat. Nos. 4,582,784 and 4,735,976 do not provide details on how a lubricant may be incorporated into an outermost layer. In order to form a backing layer with a low coefficient of friction, one often applies a separate layer comprising only the lubricant, such as wax, in the organic medium.

Blisters are characteristic defects that are often observed on the backside of a developed film. When viewed by reflected light, the defect appears as a circular-shaped topographic feature with a wrinkled surface texture. The diameter of the blister can be as large as several millimeters. Blisters not only affect the photographic image quality, but also the read-and-write ability of a magnetic layer and the image digitization, for example, by a scanner.

The objective of the present invention is to provide imaging elements with a protective overcoat composition that meets all of the physical and manufacturing requirements, as described above, while avoiding the problems and limitations of the prior art.

SUMMARY OF THE INVENTION

The present invention is an imaging element which contains a support, an image forming layer superposed on the support and an outermost protective layer superposed on the support. The protective layer is a cellulosic material and a composite wax particle. The wax particle is composed of a wax phase and a non-crosslinked polymer phase. The wax phase includes a wax having a melting point of greater than 30° C. The non-crosslinked polymer phase contains from 10% to 80% by weight of a mono-alpha, beta-ethylenically unsaturated monomer capable of addition polymerization to form a water soluble homopolymer. In a preferred embodiment the protective layer overlies an antistatic layer.

The imaging elements prepared in accordance with this invention have excellent antistatic properties, both prior to and after photographic processing, excellent resistance to scratch and ferrotyping, excellent frictional properties, and excellent resistance to surface haze or scum formation and blistering during photographic processing.

DETAILED DESCRIPTION OF THE INVENTION

The present invention provides an imaging element with a protective overcoat layer containing a cellulosic material and a composite wax particle wherein the composite wax particle has a coating weight of from 1 to 150 mg/m$^2$, preferably from 1 to 100 mg/m$^2$, and most preferably from 5 to 80 mg/m$^2$.

The composite wax particles of the present invention preferably have a wax phase composed of greater than 80% by weight of a wax having a melting point of greater than 30° C. and a non-crosslinked polymer. The composite wax particle contains from 30% to 85% by weight of said wax phase and preferably has a mean size smaller than I micron. The non-crosslinked polymer phase contains from 10% to 80% by weight of a mono-alpha, beta-ethylenically unsaturated monomer capable of addition polymerization to form a water soluble homopolymer. Wax useful for the practice of the invention has been described, for example, in references such as "The Chemistry and Technology of Waxes", A. H. Warth, 2$^{nd}$ Ed., Reinhold Publishing Corporation, New York, N.Y. 1956, and "Plastics Additives and Modifiers Handbook", Chapter 54–59, J. Ederibaum (Ed.), Van Nostrand Reinhold, New York, N.Y. 1992. Suitable waxes include hydrocarbon and/or ester containing waxes, e. g. animal waxes such as beewax, plant waxes such as carnauba wax, paraffin waxes, microcrystalline waxes, Fischer-Torpsch waxes, polyethylene waxes, polypropylene waxes, and a mixture thereof.

The composite wax particle of the present invention is preferably prepared by polymerizing a vinyl monomer or a monomer mixture in the presence of pre-formed aqueous wax particles. Pre-formed aqueous wax dispersions (or emulsions) are primarily composed of wax particles, dispersants/surfactants, and water. The dispersants can be nonionic, anionic, and cationic, and can be polymeric and are used at levels as high as 20% of the wax. Wax particles can be formed by various methods known in the art. For example, they can be prepared by pulverizing and classifying dry waxes or by spray drying of a solution containing waxes followed by redispersing the resultant particles in water using a dispersant; they can be prepared by a suspension technique which consists of dissolving a wax in, for example, a water immiscible solvent, dispersing the solution as fine liquid droplets in an aqueous solution, and removing the solvent by evaporation or other suitable techniques; they can be prepared by mechanically grinding a wax material in water to a desired particle size in the presence a dispersant, heating the wax particles dispersed in water to above their melting point, and cooling the melted particles in water to form a stable wax emulsion.

In the present invention, the pre-formed aqueous wax dispersions are formed by the so-called "atmospheric emulsification" and "pressure emulsification" techniques. The atmospheric process is used to prepare wax dispersions for waxes with melting points below the boiling point of water. The process typically consists of melting wax and surfactant together, and optionally a base is added to the melt. Hot water is then slowly added to the wax melt at vigorous agitation (water to wax). Wax emulsion can also be formed by adding molten wax/surfactant blend to boiling water at vigorous agitation. Pressure emulsification is generally needed for wax with melting points greater than 100° C. It is similar to the process described above except at temperatures above the water boiling point. Vessels capable of withstanding high pressures are normally used.

Ethylenically unsaturated monomers which are capable of addition polymerization to form a water soluble homopolymer may include, for example, (meth)acrylamides such as acrylic acid, methacrylic acid, acrylamide, methacrylamide, N,N-dimethyl acrylamide, N-methylol acrylamide, and isopropyl acrylamide, poly(ethylene glycol)(meth)acrylates, N-vinyl-2-pyrrolidone, hydroxyl ethyl methacrylate, hydroxyl ethyl acrylate, vinyl methyl ether, and the like. Ethylenically unsaturated monomers which can be used together with the above monomers may include virtually all monomers capable of undergoing addition polymerization in emulsion polymerization to produce polymers essentially water-insoluble. Typical useful monomers thus include, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitrile and amides of the same acids such as acrylonitrile, methacrylonitrile, vinyl acetate, vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene. The polymerization reaction involved in the present invention is initiated and maintained with an initiating agent or catalyst, which is very similar to those used in conventional emulsion polymerization. Most useful catalysts for the practice of the present invention are azo, diazo, and peroxide compounds, for example, benzoyl peroxide, azobisisobytyronitrile and azobiscyanovaleric acid. The amount of the initiators employed follows generally the practice in conventional emulsion polymerization. In general, the amounts can vary within the range of about 0.2 to 3 or 4 weight % or possibly higher by weight of the total monomers. It is generally recognized that higher level of initiators tends to result in lowered molecular weight for the ultimate polymers. If the polymerization is carried out in multiple stages, the amount of initiators in the beginning or initiating stage is adjusted to match the proportion of the monomer then present, and further initiators are fed during the delayed feed stage to correspond to the delayed feed of the monomers. Basically, in any case, the initiators are supplied as needed to maintain the reaction in smooth and easily controlled conditions. Surfactants that can be used in the present invention include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

Generally speaking, the reaction conditions employed in the execution of the present method parallels those utilized in conventional emulsion polymerization as regards such variables as temperature, time, agitation, equipment, etc. The reaction temperature can be maintained at a constant value or can vary from 50 to 80 or 90° C. If the reaction temperature varies, the starting temperature is usually around 50 to 55° C., and as the reaction proceeds exothermically, the temperature rises.

The time of the reaction is difficult to predict since it will depend upon other variables, such as the amount of initiating agent introduced, the reaction temperature, etc. If the amount of monomer is small, the reaction may be finished within about an hour but with larger amounts, the reaction will usually continue for 3 to 4 hours. Post-heating stages after all monomer has been added can be sued to insure that the polymerization has gone to completion and no free monomer is present. The sequence of addition of the various ingredients is not critical and can be varied. Usually, aqueous medium is first added to the reactor, then aqueous wax dispersion, and monomer in that order, all being added while the medium is thoroughly agitated, followed by the initiators, but other sequences are possible.

In one of the preferred embodiments of the invention, the polymerization process in the presence of pre-formed aqueous wax particles is carried out sequentially (see, for example, Padget, J. C. in Journal of Coating Technology, Vol 66, No. 839, pages 89 to 105, 1994). In this process, the polymerization is conducted in a monomer-starved manner.

The copolymer contained in the composite wax particles of the invention is properly designed to have good "bonding" with the wax phase and good compatibility in the solvent medium. Defining compatibility of the copolymer in the solvent medium can be achieved by using the concept of "polymer solubility map" (see, for example, Ramsbothan, J. in Progress in Organic Coatings, Vol 8, pages 113–141, 1980; and Wicks, Jr. Z. W., Jones, F. N., and Papas, S. P. in Organic Coatings, pages 229–239, 1992, John Wiley & Sons, Inc.). As the organic solvents, any of the solvents customarily used in coating compositions may be satisfactorily used.

Since the polymer contained in the composite wax particle of the invention must be soluble in a non-aqueous medium it is necessary that the polymer be firmly bound either physically or chemically to the wax phase. Otherwise the polymer may be dissolved away from the wax phase and the composite wax particles would lose its stability. Chemical bonding can be achieved by grafting of the polymer to the wax phase. One of the mechanisms may involve abstraction of hydrogen from the wax molecule by free radical present in the system, giving active centers onto which the polymer chain may grow.

Although the polymer phase contains non-crosslinked polymers, the polymers may carry in addition to the polymerizable group a chemically functional group wherein the non-crosslinked polymers are rendered crosslinkable by an external crosslinking agent and can be crosslinked after the application to a substrate of a coating composition into which the composite wax particles are incorporated.

The composite wax particles of the invention may be incorporated directly into a coating composition. Alternatively, the composite wax particles may be first isolated from the aqueous dispersion, for example, by spray drying, and then be incorporated into a liquid coating composition as a dry powder. As a further alternative, the composite wax particles thus isolated may be blended into a powder coating composition.

The protective overcoat layer of the invention further contains a cellulosic polymer as the binder for the composite wax particle. The preferred cellulosic material for the present invention is cellulose diacetate. The total amount of the cellulose diacetate and composite wax particle applied as the protective overcoat layer is preferably in the range of 0.01 to 10 g/m$^2$, and more preferably in the range of 0.1 to 2 g/m$^2$. Other additional compounds may be added to the overcoat coating composition, including surfactants, coating aids, matte particles, rheology modifiers, crosslinking agents, inorganic fillers such as metal oxide particles, pigments, antistatic agents, magnetic particles, biocide, and the like.

The imaging elements of this invention can be of many different types depending on the particular use for which they are intended. Details with respect to the composition and function of a wide variety of different imaging elements are provided in U.S. Pat. No. 5,300,676 and references described therein. Such elements include, for example, photographic, electrophotographic, electrostatographic, photothermographic, migration, electrothermographic, dielectric recording and thermal-dye-transfer imaging elements. Layers of imaging elements other than the image-forming layer are commonly referred to as auxiliary layers. There are many different types of auxiliary layers such as, for example, subbing layers, backing layers, interlayers, overcoat layers, receiving layers, stripping layers, antistatic layers, transparent magnetic layers, and the like.

In a particularly preferred embodiment, the imaging elements of this invention are photographic elements, such as photographic films, photographic papers or photographic glass plates, in which the image-forming layer is a radiation-sensitive silver halide emulsion layer. The thickness of the support is not critical. Support thickness of 2 to 10 mil (0.06 to 0.30 millimeters) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer. The emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

A preferred photographic element according to the present invention comprises one or more silver halide light sensitive emulsion layers on one side of the support and the said protective overcoat layer present on the other side of the support as an outermost backing layer, or an outermost protective layer on the top of an abrasion resistance backing layer, or an outermost layer coated on the top of an antistatic layer, or an outermost layer coated on a magnetic recording layer.

According to a first embodiment said backside protective overcoat layer is applied on a support surface which is un-subbed or subbed with an adhesion promotion layer (primer layer). The unsubbed or subbed support surface can be pre-modified with treatment such as, for example, corona discharge, plasma, solvent etching, and the like.

According to a second embodiment said backside protective overcoat layer is applied on a support which employs an abrasion resistance backing layer that comprises, for example, an acrylic polymer, a cellulose derivative, a polyurethane, a mixture of film-forming and non-film forming polymer particles, a sol-gel material, and the like. Such abrasion resistance layer compositions have been described in, for example, U.S. Pat. Nos. 4,582,784, 5,045,394, 5,232,824, and 5,447,832.

According to a third embodiment said backside protective overcoat layer is applied on a support which contains an antistatic layer that comprises, for example, a highly crosslinked vinylbenzyl quaternary ammonium polymer and a hydrophobic binder described in U.S. Pat. No. 4,070,189, a highly conductive colloidal vanadium pentoxide described in U.S. Pat. Nos. 4,203,769, and 5,006,451, a conductive fine particle of crystalline metal oxides and a film-forming binder, a conductive metal antimonate and a film-forming binder described in U.S. Pat. No. 5,368,995, and the like.

According to a fourth embodiment said backside protective overcoat is applied on a support which contains a magnetic recording layer as described in, for example, U.S. Pat. No. 4,990,276; Research Disclosure, Item 34390, November 1992; and U.S. Pat. Nos. 5,395,743, 5,397,826, 5,113,903, 5,432,050, 5,434,037, and 5,436,120.

As the non-aqueous, organic solvent, any of the members customarily used in coating compositions may be satisfactorily used. However, the preferred solvents for the practice of the present invention may include, for example, acetone, methyl ethyl ketone, methanol, ethanol, butanol, Dowanol PM, iso-propanol, propanol, toluene, xylene, methyl isobutyl ketone, n-propyl acetate, cyclohexane and their mixtures. Among all the solvents, acetone, methanol, ethanol, iso-propanol, Dowanol PM, butanol, propanol, cyclohexane and n-propyl acetate are most preferred.

The coating composition of the invention can be applied by any of a number of well-know techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in Research Disclosure No. 308119, Published Dec. 1989, pages 1007 to 1008.

The following examples are used to illustrate the present invention. However, it should be understood that the invention is not limited to these illustrative examples.

EXAMPLES 1 to 8: Composite Wax Examples

The composite wax particles used in the examples were prepared by the following process: A stirred reactor containing 438.3 g of Michemlube 160 (25% solids, from Michelman, Inc.) was heated to 85 deg. C. and purged with $N_2$ for 2 hour. 0.365 g of azobisisobutyronitrile in 10 g of toluene was then added to the reactor. An emulsion containing 109.6 g of deionized water, 32.9 g of 10% by weight Triton X100 surfactant, 9.1 g of a 10% by weight sodium dodecyl sulfonate surfactant, 87.7 g of methyl methacrylate, 21.9 g of vinyl pyrrolidone, and 0.18 g of azobisisobutyronitrile was added continuously for 2 hours. The reaction was allowed to continue for 4 more hours before the reactor was cooled down to room temperature. The composite wax particle dispersion prepared was filtered through glass fiber to remove any coagulum.

The resultant composite wax particle dispersion has a solid of about 31%. The particle contains about more than 40% by weight of carnauba wax, about 50% by weight of poly(methyl methacrylate-co-vinyl pyrrolidone) (MMA/VP 80/20) with the balance being the amount of stabilizers/dispersants used. The composite wax particle is designated as Wax-1 as seen in Table 1.

Composite wax particles Wax-2 to Wax-8 were prepared in a similar manner. Their compositions and other parameters are listed in Table 1.

TABLE 1

| Example | Wax Particle | Copolymer Composition |
|---|---|---|
| Wax-1 | ML160 (130 nm) From Michelman, Inc. | Poly(methyl methacrylate-co-vinyl pyrrolidone) MMA:VP 80/20 |
| Wax-2 | ML160 (130 nm) From Michelman, Inc | Poly(methyl methacrylate-co-vinyl pyrrolidone) MMA:VP 60/40 |
| Wax-3 | ML160 (130 nm) From Michelman, Inc | Poly(methyl methacrylate-co-vinyl pyrrolidone) MMA:VP 90/10 |
| Wax-4 | ML160 (130 nm) From Michelman, Inc | Poly(methyl methacrylate-co-hydroxyethyl methacrylate) MMA:HEMA 87.5/12.5 |
| Wax-5 | ML160 (130 nm) From Michelman, Inc | Poly(methyl methacrylate-co-N,N-dimethyl acrylamide) MMA:DMA 90/10 |
| Wax-6 | ML160 (130 nm) From Michelman, Inc | Poly(methyl methacrylate-methacrylic acid) MMA:MA 85/15 |
| Wax-7 | ML160 (130 nm) From Michelman, Inc | Poly(methyl methacrylate-co-vinyl pyrrolidone) MMA:VP 95/5 |
| Wax-8 | ML160 (130 nm) From Michelman, Inc | Poly(methyl methacrylate) MMA 100 |

EXAMPLES 9 to 20: Coating Examples

The protective overcoat coating solutions of the invention are prepared according to the following procedure. First, the aqueous composite wax particles are added to a solvent blend of acetone/methanol. The resulting dispersion of composite wax particles with approximately 5 wt % solids is then added to a solution of cellulose diacetate in acetone/methanol. The cellulose diacetate has an acetyl content of 39.8 weight percent and is designated CA398. Coating formulations with approximately 2 wt % total solids, and an 80/20 (wt/wt) ratio of the CA398 to composite wax particle, are applied onto a cellulose triacetate support which has been previously coated with an antistat layer. The antistat layer consists of a highly crosslinked vinylbenzyl quaternary ammonium polymer in combination with a hydrophobic binder and is prepared according to U.S. Pat. No. 4,070,189. The coatings are dried at 100° C. for one minute to give transparent films with an overcoat dry coating coverage of 0.4 g/m$^2$.

For comparative examples, not employing the composite wax particles of the present invention, coating formulations in acetone/methanol solvent mixtures comprising 5 wt % total solids are applied onto a cellulose acetate support which has previously been coated with a vanadium pentoxide/cellulose nitrate containing antistatic layer prepared according to U.S. Pat. No. 5,356,468. These coatings contained the same CA398 binder, or a cellulose nitrate (CN) binder, blended with a poly(methyl methacrylate-co-methacrylic acid) copolymer with an 85/15 ratio of the monomers (hereafter labeled P-1) which was prepared by emulsion polymerization. The coatings were dried under similar conditions to yield overcoats with dry coverages of 1 $g/m^2$.

The coating solution stability was evaluated by visual inspection after storage for 24 hours at room temperature. The results are listed in Table 2. "Settles Out" means that a significant amount of precipitation was seen. "Stable" means that the coating solutions were stable and no precipitation was seen. Superior coating solution stability was obtained for the coating compositions of the invention.

It is known (described in U.S. Pat. Nos. 4,735,976 and 5,006,451, and 5,221,598) that the antistatic properties of the antistat layer are destroyed after photographic processing if not protected by an impermeable barrier. Thus, the permeability of the example coatings can be evaluated by measuring the antistatic properties of the elements after processing in conventional C-41 photographic processing solutions. The internal resistivity (using the salt bridge method, described in R. A. Elder, "Resistivity Measurements on Buried Conductive Layer's", EOS/ESD Symposium Proceedings, Sept. 1990, pages 251–254) of the processed elements at 50% relative humidity is measured and compared with the internal resistivity before processing. The results are given in Table 2 as the logarithm of the measured resistivity values.

The surface haze or scum formation propensity is tested as follows: the example coatings are first processed in a C-41 processor and the dry processed strips are dipped in a C-41 stabilizer solution doctored with 500 ppm $CaCO_3$ equivalent, prepared by adding $CaCl_2$ and $NaHCO_3$ to the stabilizer solution. After dipping, the strips are hung to air-dry without rinsing or squeegying to remove excess liquid. The dried strips are evaluated under reflected light for the presence of surface haze or scum. In Table 2, "none" refers to no scum or surface haze observed on the example coating surface, and "heavy" refers to heavy scum or surface haze observed on the example coating surface.

The coefficient of friction (COF) was determined using the methods set forth in ANSI IT 9.4-1992. The results are also given in Table 2.

The examples show that the coating compositions of the invention provide transparent films with excellent protection to an underlying antistatic layer from attack by photographic processing solutions, excellent resistance to surface haze or scum formation during photographic processing, and excellent frictional characteristics. Example 9 shows that a coating composition prepared with only the starting wax material, no copolymer present, does not provide a stable coating solution. Examples 16 and 17 indicate that overcoat layers prepared according to U.S. Pat. No. 4,582,784, with a similar level of CA398 binder and a similar or higher level of MMA:MA 85/15 copolymer (P-1) to that used in the coating composition of the invention, can provide protection to an underlying antistatic layer but do not provide resistance to surface haze or scum formation and enhanced frictional characteristics. Alternatively, Example 18 shows that an overcoat layer prepared according to U.S. Pat. No. 4,735,976 provides resistance to surface haze or scum formation, but does not provide protection to an underlying antistatic layer and enhanced frictional characteristics. Finally the coating compositions in Comparative Examples 19 and 20 were prepared with Wax-7 and Wax-8, respectively. These two composite wax particles have a non-crosslinked polymer phase containing less than 10% by weight of a vinyl monomer capable of forming a water soluble homopolymer. The resultant coating solutions were not stable.

TABLE 2

| | | | Internal Resistivity log Ω/□ | | | |
|---|---|---|---|---|---|---|
| Coating | Composition (wt/wt) | Solution Stability | Before C-41 Processing | After C-41 Processing | Scum or Surface Haze | COF |
| Example 9 (Comparative) | CA398/ML160 (80/20) | Settles Out | | | | |
| Example 10 (Invention) | CA398/Wax-1 (80/20) | Stable | 8.8 | 9.3 | None | 0.15 |
| Example 11 (Invention) | CA398/Wax-2 (80/20) | Stable | 8.3 | 9.4 | None | 0.15 |
| Example 12 (Invention) | CA398/Wax-3 (80/20) | Stable | 8.3 | 9.4 | None | 0.15 |
| Example 13 (Invention) | CA398/Wax-4 (80/20) | Stable | 8.5 | 10.7 | Light | 0.12 |
| Example 14 (Invention) | CA398/Wax-5 (80/20) | Stable | 8.3 | 9.7 | Medium | 0.15 |
| Example 15 (Invention) | CA398/Wax-6 (80/20) | Stable | 8.9 | 10.8 | None | 0.15 |
| Example 16 (Comparative) | CA398/P-1 (90/10) | Stable | 7.5 | 7.9 | Heavy | 0.5 |
| Example 17 (Comparative) | CA398/P-1 (75/25) | Stable | 7.5 | 7.3 | Heavy | 0.5 |
| Example 18 (Comparative) | CN/P-1 (25/75) | Stable | 6.6 | >12.5 | None | 0.5 |
| Example 19 (Comparative) | CA398/Wax-7 (80/20) | Settles out | | | | |

TABLE 2-continued

| Coating | Composition (wt/wt) | Solution Stability | Internal Resistivity log Ω/□ Before C-41 Processing | After C-41 Processing | Scum or Surface Haze | COF |
|---|---|---|---|---|---|---|
| Example 20 (Comparative) | CA398/Wax-8 (80/20) | Settles out | | | | |

While it has been shown and described what are at present the preferred embodiments of the invention, various modifications and alterations will be obvious to those skilled in the art. All such modifications and alterations are intended to be included in the following claims.

What is claimed is:

1. An imaging element comprising:

a support;

an image forming layer superposed on said support; and an outermost protective layer superposed on the support comprising a cellulosic material and a composite wax particle comprising a wax phase and a non-crosslinked polymer phase, the wax phase comprising a wax having a melting point of greater than 30° C., the non-crosslinked polymer phase formed from 10 to 80% by weight of a mono-alpha, beta-ethylenically unsaturated monomer capable of addition polymerization to form a water soluble homopolymer.

2. The imaging element of claim 1 wherein the wax particle comprises a mean size smaller than 1 micron.

3. The imaging element of claim 1 wherein the wax phase of the wax particle further comprises dispersants/surfactants or water.

4. The imaging element of claim 1 wherein the wax comprises animal waxes, plant waxes, paraffin waxes, microcrystalline waxes, Fischer-Torpsch waxes, polyethylene waxes or polypropylene waxes.

5. The imaging element of claim 1 wherein the ethylenically unsaturated monomer capable of addition polymerization to form a water soluble homopolymer comprises acrylic acid, methacrylic acid, acrylamide, methacrylamide, N,N-dimethyl acrylamide, N-methylol acrylamide, and isopropyl acrylamide, poly(ethylene glycol)(meth)acrylates, N-vinyl-2-pyrrolidone, hydroxyl ethyl methacrylate, hydroxyl ethyl acrylate or vinyl methyl ether.

6. The imaging element of claim 1 wherein the cellulosic material comprises cellulose diacetate.

7. The imaging element of claim 1 wherein the protective overcoat further comprises surfactants, coating aids, matte particles, rheology modifiers, crosslinking agents, inorganic fillers, pigments, antistatic agents, magnetic particles or biocides.

8. An imaging element comprising:

a support;

an image forming layer superposed on said support;

an antistatic layer comprising an antistatic agent and a film forming binder; and an outermost protective layer superposed on the support comprising a cellulosic material and a composite wax particle comprising a wax phase and a non-crosslinked polymer phase, the wax phase comprising a wax having a melting point of greater than 30° C., the non-crosslinked polymer phase formed from 10 to 80% by weight of a mono-alpha, beta-ethylenically unsaturated monomer capable of addition polymerization to form a water soluble homopolymer.

9. The imaging element of claim 8 wherein the wax particle comprises a mean size smaller than 1 micron.

10. The imaging element of claim 8 wherein the wax phase of the wax particle further comprises dispersants/surfactants or water.

11. The imaging element of claim 8 wherein the wax comprises animal waxes, plant waxes, paraffin waxes, microcrystalline waxes, Fischer-Torpsch waxes, polyethylene waxes or polypropylene waxes.

12. The imaging element of claim 8 wherein the ethylenically unsaturated monomer capable of addition polymerization to form a water soluble homopolymer comprises acrylic acid, methacrylic acid, acrylamide, methacrylamde, N,N-dimethyl acrylamide, N-methylol acrylamide, and isopropyl acrylamide, poly(ethylene glycol)(meth)acrylates, N-vinyl-2-pyrrolidone, hydroxyl ethyl methacrylate, hydroxyl ethyl acrylate or vinyl methyl ether.

13. The imaging element of claim 8 wherein the cellulosic material comprises cellulose diacetate.

14. The imaging element of claim 8 wherein the protective overcoat further comprises surfactants, coating aids, matte particles, rheology modifiers, crosslinking agents, inorganic fillers, pigments, antistatic agents, magnetic particles or biocides.

15. The imaging element of claim 8 wherein the antstatic agent comprises a vinylbenzyl quaternary ammonium polymer, colloidal vanadium pentoxide, a conductive fine particle of crystalline metal oxides or a conductive metal antimonate.

16. The imaging element of claim 8 further comprising a magnetic recording layer superposed on the support.

* * * * *